US005630887A

United States Patent [19]

Benum et al.

[11] Patent Number: 5,630,887

[45] Date of Patent: May 20, 1997

[54] TREATMENT OF FURNACE TUBES

[75] Inventors: Les W. Benum, Red Deer; William Wong; Mike C. Oballa, both of Calgary, all of Canada

[73] Assignee: Novacor Chemicals Ltd., Calgary, Canada

[21] Appl. No.: 650,224

[22] Filed: May 20, 1996

Related U.S. Application Data

[63] Continuation of Ser. No. 387,096, Feb. 13, 1995, abandoned.

[51] Int. Cl.[6] ..... C23C 8/10

[52] U.S. Cl. ..... 148/280; 148/286

[58] Field of Search ..... 148/280, 286

[56] References Cited

U.S. PATENT DOCUMENTS

| | | | |
|---|---|---|---|
| 2,269,601 | 1/1942 | Perrin | 148/280 |
| 4,266,987 | 5/1981 | Wang | 148/280 |
| 4,424,083 | 1/1984 | Polizzotti et al. . | |
| 5,169,515 | 12/1992 | Ngan et al. | 208/48 R |
| 5,288,345 | 2/1994 | Ohhashi et al. | 148/514 |

FOREIGN PATENT DOCUMENTS

| | | | |
|---|---|---|---|
| 2092621 | 8/1982 | United Kingdom | 148/286 |

OTHER PUBLICATIONS

Reduction of Coke Deposition in Ethylene Furnaces, Ta–Chi Luan, PhD. Thesis, Purdue Univ., Aug. 1993.

*Primary Examiner*—Sam Silverberg
*Attorney, Agent, or Firm*—Kenneth H. Johnson

[57] ABSTRACT

Stainless steel which is used in applications in the petrochemical industry may be treated by exposure to an atmosphere containing a low amount of oxygen at temperatures up to 1200° C. for up to about 50 hours. The treated steel has a lower tendency to coke during use.

1 Claim, No Drawings

TREATMENT OF FURNACE TUBES

This application is a continuation of application Ser. No. 08/387,096 filed Feb. 13, 1995 now abandoned.

FIELD OF THE INVENTION

The present invention relates to the treatment of stainless steel. More particularly the present invention relates to the treatment of high chromium stainless steel to reduce carburization or coking in applications where the stainless steel is exposed to a hydrocarbon atmosphere at elevated temperatures. Such stainless steel is used in a number of applications, particularly in the processing of hydrocarbons and in particular in pyrolysis processes such as the dehydrogenation of ethane to ethylene; reactor tubes for cracking hydrocarbons; or reactor tubes for steam cracking or reforming.

BACKGROUND OF THE INVENTION

There are a number of references relating to the treatment of stainless steel for use in pyrolysis processes. One of the leading researchers is Professor L. Albright at the University of Purdue. The summary of the Ph.D. thesis by Ta-Chi Luan "Reduction of Coke Deposition in Ethylene Furnaces" published August 1993 discloses treating various alloys with mixtures of hydrogen and water. The ratio of hydrogen to water appears to be about 50:1 (pages 16 and 17) which is greater than that contemplated in the present invention.

U.S. Pat. No. 5,169,515, issued Dec. 12, 1992, assigned to Shell, teaches the treatment of stainless steel furnace tubes at temperatures from 1800°, preferably from 1900° to 2200° F. (about 1,000°–1200° C.) with hydrogen and steam in a ratio from 0.05 to 5 and in the presence of from about 100 to 500 ppm of hydrogen sulphide or a compound which generates hydrogen sulphide. The Shell patent teaches that the steam (or water) must be present in an amount of about 5 weight % to 500 weight % of the hydrogen. The present process is directed to a process using significantly lower amounts of steam.

U.S. Pat. No. 5,288,345, issued Feb. 22, 1994 to NKG Insulators Inc., discloses treating a sintered alloy containing aluminum at a temperature from 800° to 1300°, preferably from 1,000° to 1200° C. in an atmosphere which contains water in an amount corresponding to a dew point of from 30° to 60° C. This is a larger amount of water than required by the present inventors. Further, the object of the treatment is to reduce oxidation and there is no reference in the disclosure to carburization.

U.S. Pat. No. 4,424,083, issued Jan. 3, 1984 to Exxon Research and Engineering Corporation, discloses shot peened stainless steel in an atmosphere containing hydrogen and steam having a dew point of 60° C. Again, this is a higher amount of hydrogen than specified in the present patent application.

All of the above art teaches treating stainless steel with hydrogen or an inert atmosphere such as nitrogen containing relatively high amounts of an oxidizing gas such as water or steam, in amounts of at least 2%. The present invention is directed to treating stainless steel with an inert atmosphere containing smaller amounts of an oxidizing gas.

SUMMARY OF THE INVENTION

The present invention provides a method of treating a steel alloy, preferably cast steel, comprising at least 23 weight % chromium comprising subjecting said steel to a low oxidizing atmosphere at a temperature from 850° to 1200° C. for a time of at least 1 hour.

The present invention also provides stainless steel treated in accordance with the above process, and in particular furnace tubes for the conversion of ethane to ethylene.

The present invention further provides a cast stainless steel object having a surface comprising less than 3 wt. % of iron, less than 1 wt. % of nickel, from 15 to 25 wt. % of manganese, and from 60 to 75 wt. % of chromium. Preferably the object is prepared by casting and subsequent treatment as indicated above.

The present invention also provides in a process for producing ethylene by passing ethane through a furnace the improvement comprising using furnace, tubes as described above.

DETAILED DESCRIPTION

The stainless steel to be treated in accordance with the present invention typically is a cast HP alloy. Typically the stainless steel will comprise from about 23 to 35, preferably from 24 to 35 weight % of chromium. The steel may further comprise from 25 to 50, preferably from 30 to 45 weight % of nickel (Ni); from 1 to 3, preferably from 1.5 to 2.5 weight % of manganese (Mn); from 1 to 2, preferably from 1.5 to 2 weight % of silica (Si). The balance of the steel composition will be predominantly iron with other trace amounts (e.g. for elements other than carbon, typically less than 1 wt %, preferably from 0.1 to 1.0 weight %) of elements such as carbon, titanium, and tungsten, as is well known in the metallurgy arts.

While the steel may have the above bulk composition, it is also possible to treat steel having a similar bulk composition but a different composition with a surface layer to provide the above composition to achieve the results of the present invention. The surface layer may also contain some aluminum.

Typically the steel is treated at a temperature from 850° C. to 1200° C., preferably from 900° C. to 1050° C. for a period of time of at least one hour. Preferably the treatment is carried out for a period of time of at least 5 hours, most preferably for a time of at least 10 hours. Suitable treatment time may be from 10 to 50, preferably from 10 to 40 hours at a temperature from 900° C. to 1050° C.

The atmosphere with which the stainless steel is treated comprises a predominant proportion, at least 98 weight % of one or more gases selected from the group consisting of an inert gas and a reducing gas. The reducing gas may be selected from the group consisting of hydrogen, carbon monoxide and carbon dioxide. The inert gas may be selected from the group consisting of nitrogen argon and helium. The predominant proportion of the gas may comprise from at least 10 weight % of one or more reducing gases and from 0 to 88 weight % of one or more inert gases.

The balance of the treatment gas is an oxidizing gas to provide a mixture having a partial pressure of oxygen less than about $10^{-18}$ atmospheres, preferably less than about $10^{-20}$ atmospheres. Preferably, the balance of the gas or atmosphere is water (which will be steam) at the temperatures of treatment. Although less desirable, it is believed that air, and possibly oxygen per se, might also be used as the oxidizing gas. Typically, the oxidizing gas will be used in an amount to provide an amount of oxygen in at most 2, preferably from 0.5 to 1.5 weight % of steam.

From an industrial point of view, the combination of gases most likely available at an industrial cracking plant will be hydrogen and steam. Practically, one method to achieve this result is to saturate industrial hydrogen with ice water. That is, the hydrogen is bubbled through a tank of water at a temperature from less than to about 40° F. (about 5° C.) typically from 40° to 32° F. (from about 5° to 0° C.), most preferably about 32° F. (e.g. 0° C.).

While not wishing to be bound by theory, it is believed that the treatment slowly and selectively oxidizes sites in the metal which catalytically carbonize the hydrocarbon passing through or over the steel. Typically the surface of the treated tube will comprise less than about 3, most preferably less than about 1 weight% of iron; less than 3, preferably less than about 1 weight % of nickel; from about 15 to 25, preferably from about 20 to 25 weight % of manganese and from about 60 to 75, preferably 70 to 75 weight % of chromium with a balance of trace elements such as silica, niobium, aluminum, etc. Typically the depth or thickness of the surface arising from such a treatment will be at least 20 microns thick, preferably from 20 to 45, most preferably from 25 to 35 microns thick.

The stainless steel may be in its final form and the surface of the steel is exposed to the treatment in accordance with the above conditions. Typically the steel will be fabricated into a finished form such as a pipe or furnace tube. However, the steel may be fabricated into other forms such as baffles, trays or even honeycombs such as for a catalytic converter for an internal combustion engine.

In a preferred embodiment of the present invention there is provided the process of converting ethane to ethylene in a furnace. Typically in such an operation ethane is fed into a tube, typically from about 1.5 to 8, typically furnace tubes will have an outside diameter from 2 to 7 inches (e.g. 2 inch, 3 inch, 3.5 inch, 6 inch and 7 inch outside diameter) (about 3.7 to 20; typically about 5 to 16.5 cm (e.g. about 5 cm, about 7.6 cm, about 8.9 cm, about 15.2 cm and about 20 cm)) in outside diameter, which runs through a furnace maintained at a tube metal temperature of from 900° to 1050° C., and a process outlet (gas) temperature of about 840°–850° C. As the ethane passes through the furnace it releases hydrogen and becomes ethylene (the cracked gas plus byproducts such as hydrogen). The typical operating conditions such as temperature, pressure and flow rates for such a process are well known to those in the art.

The present invention will now be illustrated by the following example.

EXAMPLE 1

(Commercial Plant Test)

Stainless furnace tubes of cast HP alloy were treated with an atmosphere of hydrogen which had been bubbled through ice water to saturate it with water. The treatment gas was then passed through the tubes heated at 1000° C. for a period of time of about 50 hours. The tubes were then fitted into an ethylene furnace and used in the cracking of ethane to ethylene. The furnace tube did not have to be decoked for a period of time of at least 139 days. The typical time for decoking of a similar furnace tube in the same furnace design and under the same process conditions including the same feedstock, which has not been treated is less than 50 days.

It is believed that other plants have achieved 90 day runs before decoking the tubes. However, it is also believed that such plants operate under different conditions such as: using an ethane source having higher amounts of sulphur and/or sulphide generating compounds which are believed to extend the time between decoking; and/or using a different furnace design and/or a different coil or tube configuration.

EXAMPLE 2

(Laboratory Test Results)

A stainless steel comprising 16 wt. % iron, 45 wt. % nickel; 35 wt. % chromium, and 1 wt. % of manganese was treated in the same manner as set forth in Example 1. The surface of the alloy was subsequently analyzed and found to comprise 1 wt. % iron, about 1 wt. % nickel, about 75 wt. % chromium, and about 22 wt. % manganese. The treatment appears to alter the composition of the steel at the surface.

What is claimed is:

1. A method of treating a cast steel alloy comprising from 23 to 35 wt. % of chromium; from about 25 to 50 wt. % of Ni; from 1 to 3 wt. % of Mn; from 1 to 2 wt. % of Si; from 0.1 to 1.0 wt. % of one or more elements selected from the group consisting of carbon, titanium, tungsten and the balance iron, comprising subjecting said steel to an atmosphere having an oxygen partial pressure of less than $10^{-20}$ atmospheres and comprising an oxygenate equivalent from 0.5 to 1.5 wt. % steam; from 10 to 99.5 wt. % of one or more reducing gases selected from the group consisting of hydrogen, CO and $CO_2$ and from 0 to 88 wt. % of one or more gases selected from the group consisting of nitrogen, argon, and helium for a period from 5 to 40 hours at a temperature from 900° to 1050° C. to generate a surface layer from 20 to 45 microns thick comprising less than 3 wt. % iron; less than 3 wt. % nickel; from 15 to 25 wt. % manganese; from 60 to 75 wt. % chromium; and the balance silica, niobium, and aluminum.

* * * * *